US007740367B2

(12) United States Patent
Koren

(10) Patent No.: US 7,740,367 B2
(45) **Date of Patent: *Jun. 22, 2010**

(54) DETACHABLE POOL LIGHT

(75) Inventor: Paul Koren, Altamonte Springs, FL (US)

(73) Assignee: Nexxus Lighting, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/761,580

(22) Filed: Jun. 12, 2007

(65) Prior Publication Data

US 2007/0263378 A1 Nov. 15, 2007

Related U.S. Application Data

(63) Continuation of application No. 10/292,664, filed on Nov. 12, 2002, now Pat. No. 7,244,037.

(51) Int. Cl.
*F21V 33/00* (2006.01)

(52) U.S. Cl. ..... 362/101; 362/147

(58) Field of Classification Search ..... 362/101, 362/555, 556, 800; 439/282, 351
See application file for complete search history.

(56) References Cited

U.S. PATENT DOCUMENTS

| | | | |
|---|---|---|---|
| 3,469,044 | A | 9/1969 | Dickerson |
| 3,569,692 | A | 3/1971 | Johnson et al. |
| 3,621,447 | A | 11/1971 | Taylor et al. |
| 3,665,368 | A | 5/1972 | Ellis |
| 3,742,427 | A | 6/1973 | Ballard |
| 3,864,562 | A | 2/1975 | Hawkins |
| 3,962,675 | A | 6/1976 | Rowley et al. |
| 4,053,758 | A | 10/1977 | Shaw |
| 4,156,894 | A | 5/1979 | Berry |
| 4,290,094 | A | 9/1981 | Jensen |
| 4,344,118 | A | 8/1982 | Rundquist et al. |
| 4,433,366 | A | 2/1984 | Wade |
| 4,450,511 | A | 5/1984 | Micha |
| 5,051,875 | A | 9/1991 | Johnson |
| 5,122,936 | A | 6/1992 | Guthrie |
| 5,144,545 | A | 9/1992 | Klitzing |
| 5,432,688 | A | 7/1995 | Tobias et al. |
| 5,556,188 | A | 9/1996 | Poppenheimer |
| 5,980,076 | A | 11/1999 | Dunn et al. |
| 6,174,067 | B1 | 1/2001 | Thrasher et al. |
| 6,184,628 | B1 | 2/2001 | Ruthenberg |
| 6,241,361 | B1 | 6/2001 | Thrasher et al. |
| 6,250,776 | B1 | 6/2001 | Burkitt et al. |
| 6,304,702 | B1 | 10/2001 | Potucek et al. |
| 6,348,942 | B1 | 2/2002 | Watkins |
| 6,472,990 | B2 | 10/2002 | Delmar |
| 6,510,277 | B1 | 1/2003 | Dongo |
| 6,595,671 | B2 | 7/2003 | Lefebvre et al. |

*Primary Examiner*—Hargobind S Sawhney
(74) *Attorney, Agent, or Firm*—McGuireWoods LLP

(57) ABSTRACT

A swimming pool light assembly for connecting a light to a side wall of a pool where a pool light niche is not provided, said assembly can have an interchangeable light, a watertight connector comprising a first end and a second end operable to deliver at least one of power and control signals to said light through said first end, and a cable with a first end connected to said connector for providing at least one of power from a power source and a control signal from a controller to said light, wherein said light is operable for connecting and disconnecting from said watertight connector while both said connector and said light are submerged in water.

18 Claims, 3 Drawing Sheets

DETACHABLE POOL LIGHT

CROSS-REFERENCE TO RELATED APPLICATIONS

This application is a continuation of U.S. patent application Ser. No. 10/292,664, filed on Nov. 12, 2002, the disclosure of which is incorporated by reference herein.

BACKGROUND OF THE INVENTION

The present invention relates to swimming pool lights and, more particularly, to a swimming pool light that is easily removable wherein a plurality of different light fixtures may be placed within the pool using a single connector for all light fixtures.

Currently water within a swimming pool is lighted by an incandescent light that is housed within a watertight fixture that is situated within a cavity that is within a pool wall, or a niche in a pool wall, below a water line. The cavity, or niche, is required in the wall of the pool because the incandescent light has a longitudinal length, wherein the niche is need to place the bulb so that it does not extend into the pool. Typically the niche is one of the greatest places for a leak to occur in a pool because of the size of the niche or area cut from the pool wall. Leaks occur because anytime you have a protrusion through a pool wall, such as a niche, the greater the protrusion, the greater the chance for a leak. The watertight fixture has an outer lens that may protrude slightly into the pool. When a new bulb is needed, the whole fixture is removed from the cavity, wherein a power cable supplying electricity to the light is long enough for the fixture to be safely positioned out of the pool water.

Typically, a clear, incandescent light bulb is placed in the fixture. If a colored effect is desired, such as blue, red or green, then a different color bulb is placed in the fixture. In another embodiment, typically used in spas, the outer lens is replaced with a colored lens, or a colored lens cover fits over the clear lens. In each of these situations, a user has to manually make a modification to the pool light to produce a desired color. However, if the user desires a continuously varying of colors where the intensity of the light is not lessened, such an option is not currently available.

Standard electrical wiring connects the watertight fixture to a 110-volt source. Providing a 110-volt source to such an underwater fixture presents an element of risk that many would prefer to avoid. Also, because of the illumination patterns of incandescent lamps, they frequently expose imperfections in the interior surface of the swimming pools as a consequence of the light's diffusion of light and the intensity of the light source.

It is known in the prior art to provide light emitting diode ("LED") lighting assemblies for swimming pools, but such systems are frequently designed for aboveground pools and hot tubs. There are also known LED lighting assemblies for in-ground pools that house LED arrays that rotate to achieve variations of emitted color patterns. Typically such assemblies will employ a combination of red, green and blue LED arrays, which permit the generation of up to 26,000 colors, as is also well known in the art. For example, it is believed that U.S. Pat. No. 6,184,628 (the "'628 Patent") teaches the use of predetermined arrays of a plurality of different color LED bulbs to replace an incandescent pool light, where the plurality of different color LED bulbs are wired in such a manner that the predetermined rays of a plurality of different colored LED bulbs activate at predetermined sequences for predetermined time intervals wherein the bulbs are encased in a lens.

Even though LED bulbs are used, providing LED lighting fixtures with brightness to rival incandescent bulbs is still an issue, especially when not all of the LED bulbs are illuminated, as suggested in the '628 Patent. As is also evident with the '628 Patent, the '628 patent is disclosed for placement within a niche. Thus, removing the invention disclosed in the '628 Patent from the niche is just as cumbersome as removing an incandescent light bulb from a niche and its enclosure.

BRIEF SUMMARY OF THE INVENTION

The present invention is directed to a detachable light assembly for a swimming pool, spa or another body of water where the light source does not have to be placed in a niche formed in a wall of a container holding the body of water, and where the primary light is removed and a plurality of other light assemblies may be connected to a power source while underwater. Towards this end, a swimming pool light assembly for connecting a light to a side wall of a pool is provided where a pool light niche is not needed. The assembly includes an interchangeable light, and a watertight connector to deliver power and/or control signals to the light. A cable for providing power from a power source and/or a control signal from a controller to the light is also provided. The light is operable for connecting and disconnecting from the watertight connector while both the connector and the light are submerged in water.

In another preferred embodiment, an underwater light system is disclosed. The underwater light system comprises a submersible light that is interchangeable with other lights and has a connection end. A watertight connector is also provided that is operable to receive power and/or a control signal for delivery to the light. A power source for providing power to the light and/or a controller for providing a control signal to the light is also provided. A cable with for providing power from the power source and/or a control signal from the controller to the light is also part of the system. The light may be connected and disconnected from the watertight connector while both the connector and light are submerged in water.

In another preferred embodiment, a submersible light system for replacing a niche light system in swimming pools wherein a niche is already cut into a side of the swimming pool is disclosed. The system comprises a plate to fit within the niche comprising a hole formed therethrough the plate. A submersible light comprising a lens cover and a connection end is provided. A watertight connector to receive power and/or a control signal and to deliver power and/or a control signal to the light is also part of the system. A cable with a first end connected to the connector for providing power from a power source and/or a control signal from a controller to the light is also part of the system. The plate closes the niche and the light is operable for connecting and disconnecting from the watertight connector through the plate while both the connector and light are submerged in water.

BRIEF SUMMARY OF THE DRAWINGS

The invention itself, both as to organization and method of operation, may best be understood by reference to the following description in conjunction with accompanying drawings, in which like numbers represent parts throughout the drawings and in which.

DETAILED DESCRIPTION OF THE INVENTION

With reference to the figures, exemplary embodiments of the invention will now be described. The scope of the invention disclosed is applicable to a plurality of uses. Thus, even though embodiments are described specifically to swimming pool light fixtures, the present invention is applicable to other uses or applications such as, but not limited to, spas, ponds, and man-made lakes. Additionally, other examples include uses in the area of architectural lighting such as interior and exterior lighting of residential homes, office complexes and/or other buildings. Similarly, the same or other embodiments may be used in landscaping, such as illuminating sidewalks, pools of water, waterfalls or any other area that needs to be illuminated, including underwater applications. Furthermore, though the present invention is disclosed specific to LED lights, other forms of lights, such as fiber optic lighting and laser lighting, but not limited to these three forms of lighting, are also applicable to the present invention. Finally, the present invention is illustrated primarily with respect for use with gunite swimming pools wherein certain aspects of the invention are specific to gunite pools. Those skilled in the art will readily recognize that a plurality of ways are available to implement the present invention depending on the type of pool the present invention is being applied to.

Figure 1:
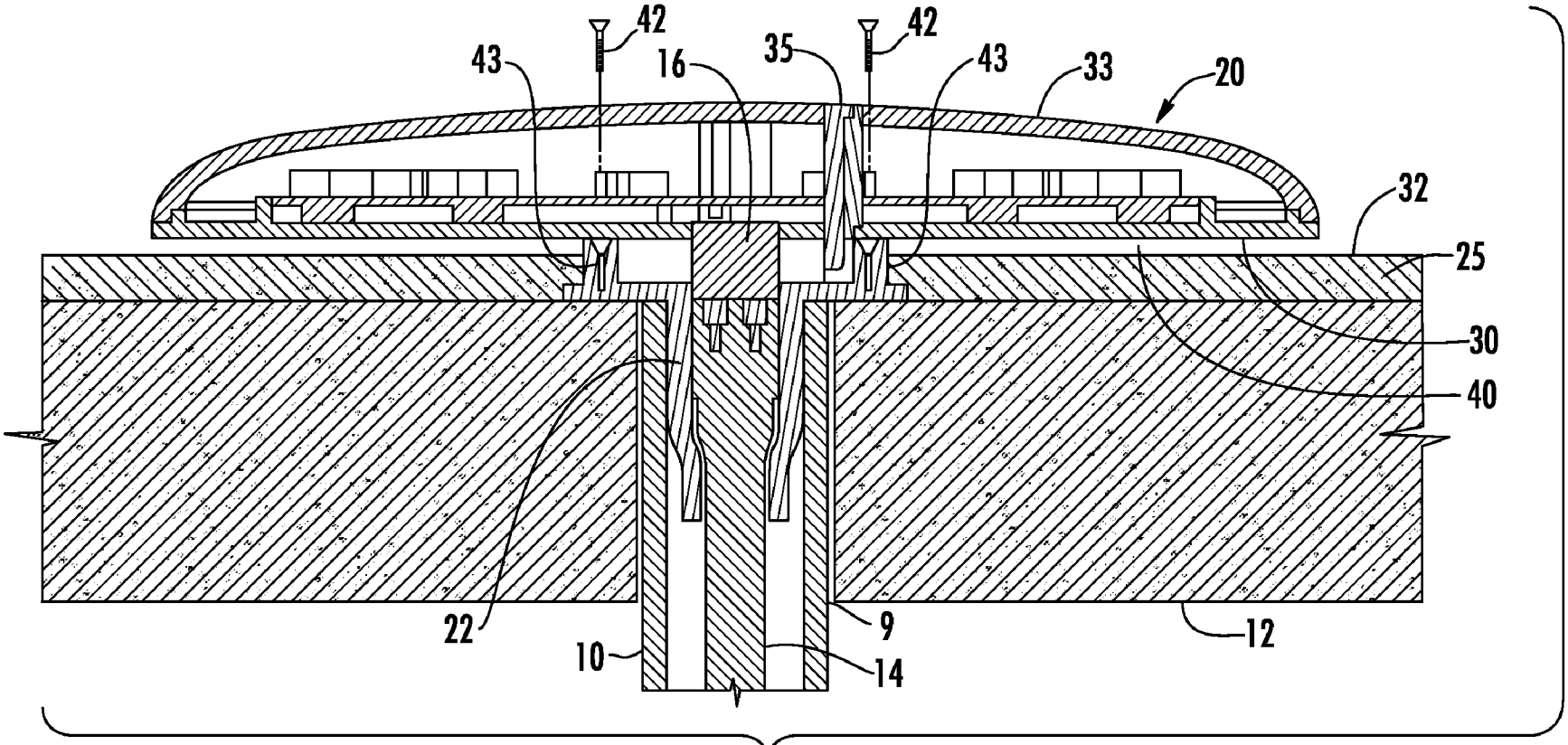
FIG. 1 is a cross sectional view of a removable light assembly connected to a waterproof connector positioned in a side of a swimming pool.

FIG. 1 is an exemplary embodiment of a cross-sectional view of a preferred embodiment of the present invention. The embodiment in FIG. 1 is specific to a pool made of gunite. As illustrated, an opening 9 is provided through a sidewall 12 of a container holding a body of water, such as a sidewall of a swimming pool. A pipe 10 is placed through the opening 9. A power cable, or electrical conduit, 14 is fed through the pipe 10 and is connected to an underwater connector 16. In a preferred embodiment, in addition to providing electrical power to a light fixture 20 through the power cable 14, feeds are provided to connect the light 20 to a controller (not shown), which is used to control whether the light 20 is on or off, as well as to determine color patterns to be illuminated from the light 20.

For a gunite pool, an adapter 22 is fitted into the pipe 10 and around the power cable 14 wherein the watertight connector 16 is fitted to the adapter 22. In constructing the gunite pool, once the adapter 22 is placed within the opening 9 through the base wall 12, gunite 25 is applied around the part of the adapter 22 that extends from the base wall 12. In a preferred embodiment, the adapter 22 still has an edge that extends beyond the gunite 25 surface 32. In another preferred embodiment, the edge does not extend beyond the gunite 25 surface 32. In one preferred embodiment, at the area between the back surface 30 of a light 20 and the gunite 25 surface 32 of the pool, a foam insert (not shown) is positioned in this opening 40 prior to inserting the light 20 into the underwater connector 16. The light assembly 20 is connected into the adapter 22 via connectors 42, such as, in a preferred embodiment, by bolts, such as three bolts 42.

Figure 2:
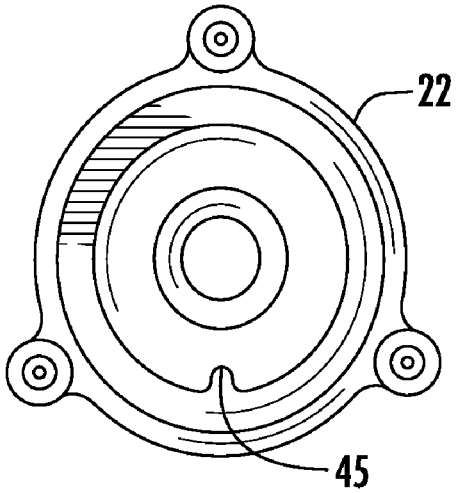
FIG. 2 is a front view of the watertight connector and adapter illustrating a locking notch.

In one embodiment, the bolts 42 engage respective receptacles 43 in the adapter 22. In another preferred embodiment, connectors, such as bolts 42, engage respective receptacles (not shown) in the swimming pool wall. In another preferred embodiment an adapter 22 and connector 16 are a single, integrated unit wherein the receptacles 43 are disclosed in this integrated unit. As illustrated in FIG. 2, the light 20, connector 16 and/or adapter 22 will include an alignment pattern mark 45, such as a notch 45, wherein the light 20 may only be engaged into the connector 16 in one direction. The bolts 42 are tightened until a watertight seal is formed between the light 20 and the adapter 22 and/or connector 16.

In a preferred embodiment, a watertight indicator 35 is provided, such as a reverse plunger, wherein when the light 20 is properly secured, the plunger 35, which starts beneath the surface of the outer lens cover 33 of the light 20, rises as the bolts 42 are tightened until the light 20 has achieved a secured watertight seal. When the watertight seal is achieved, the top of the plunger 35 is level with the top cover of the lens 33 or is flush with surface of the lens cover 33.

Figure 3:
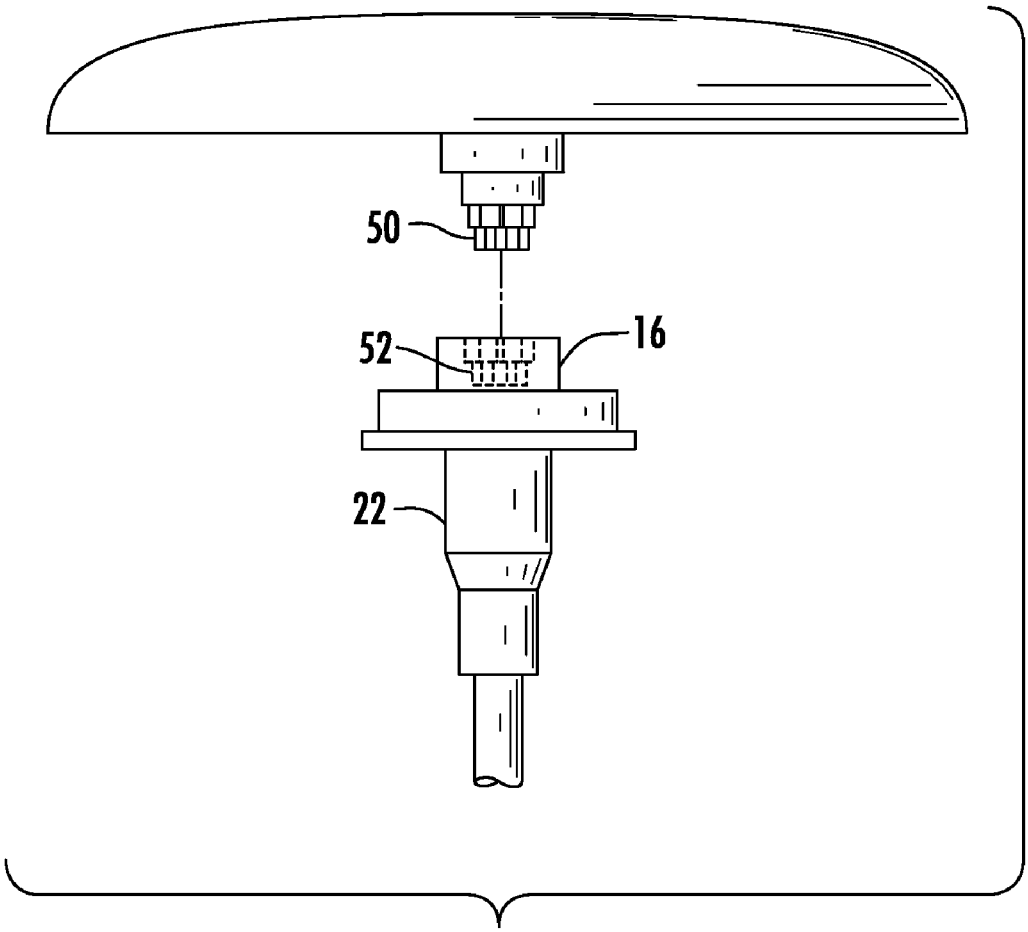
FIG. 3 is a perspective view of a watertight connector with a light wherein the connection end of the light is displayed.

As illustrated in FIG. 3, in a preferred embodiment, the end of the light or prongs 50 that engage the connector 16 extends from the back of the light and plugs into openings 52 in the connector 16. In another preferred embodiment (not shown), the connector 16 has prongs that extend from the connector 16 and engages openings on the back of the light 20. In another preferred embodiment (not shown), instead of providing bolts 42, or other connectors, to secure the light 20 to the adapter 22 and/or connector 16, the connector 16 is designed wherein the light 20 has prongs 50 on a back end that fit within openings 52 in the connector 16 and the light 20 is then rotated until the prongs 50 lock into the openings 52 of connector 16 and/or adapter 22. In each embodiment, when the prongs 50 from the light 20 engage the openings 52, or receptacles, of the connector 16, the water is pushed out from the connector 16; thus, sealing the connection and forcing water from interfering with the connection of the light 20 to the power source and the controller provided through the connector 16 via the cable 14. One skilled in the art will readily recognize a plurality of ways in which to connect the light 20 to the connector 16 and/or pool's side.

Figure 4:
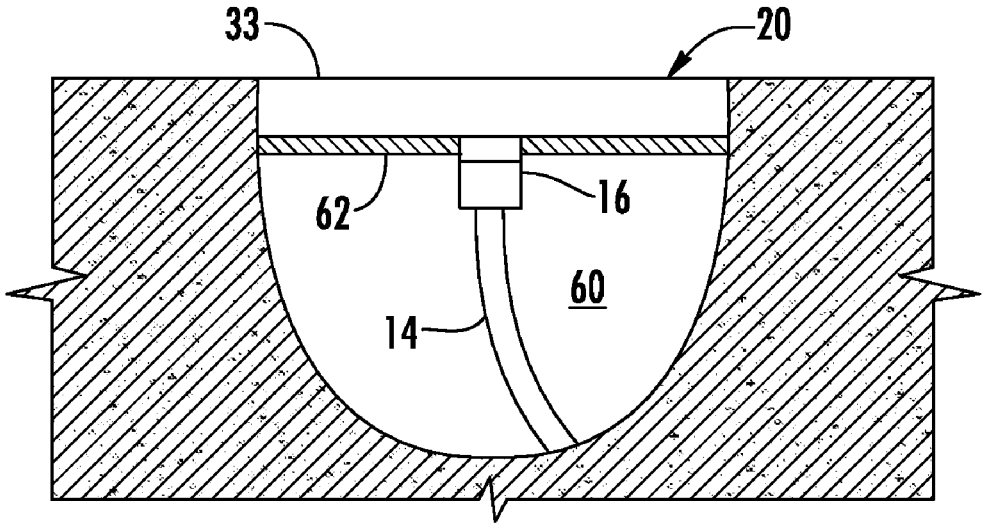
FIG. 4 is an exemplary embodiment of the preferred invention configured to fit within a pool with an existing niche.

In another preferred embodiment, exemplarily illustrated in FIG. 4, where a niche 60 is already provided in the wall of a swimming pool, and a decision is made to use the present invention, a plate 62 is provided which fits within the niche 60, in essence, closing off the niche 60 so that the light 20 will then fit on the plate 62 and the connector 16 and cable 14 are placed through an opening in the plate 62. In one preferred embodiment illustrated in FIG. 4, instead of the plate 62 being positioned where the light 20 extends into the pool or body of water, the plate 62 is fixed further into the niche 60 and the light 20 is of a diameter wherein it fits within the niche 60, so that the lens cover 33 of the light 20 is flush or is in the same plane as the surface of the pool. As discussed above, the connector 16 is still provided through the plate 62; however, the adapter 22 is not necessarily needed. Likewise, for other pools types, such as vinyl and fiberglass, the adapter 22, described herein is not necessarily needed.

Figure 5:
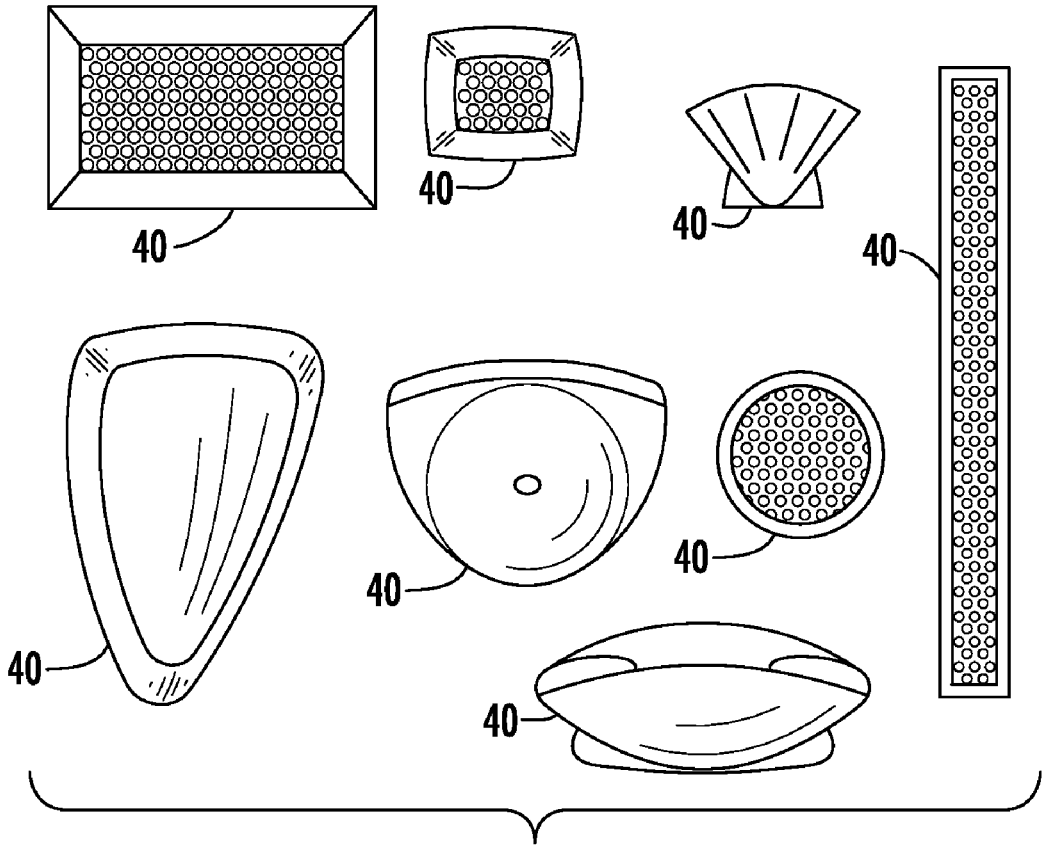
FIG. 5 displays exemplary embodiments of various light assemblies configurations that may be attached to the waterproof connector.

Thus, once the watertight connector 16 is properly secured and is in place, a user can easily exchange or remove the light 20 that is currently in place and replace it with a plurality of other lights 40 of varying sizes and shapes, as is exemplarily illustrated in FIG. 5, which illustrates a perspective view and side view of a plurality of lenses attached to a pool wall.

While the invention has been described in what is presently considered to be a preferred embodiment, many variations and modifications will become apparent to those skilled in the art. Accordingly, it is intended that the invention not be limited to the specific illustrated embodiment, but be interpreted within the full spirit and scope of the appended claims.

What is claimed is:

1. A swimming pool light assembly for connecting a light fixture to a wall of a pool, said assembly comprising:

a light fixture;

a watertight connector comprising a first end and a second end operable to deliver at least one of power and control signals to said light fixture through said first end;

a cable with a first end connected to said watertight connector for providing power from a power source to said light fixture;

an adapter to secure said watertight connector and said cable within said wall, wherein the adapter is positionable within the wall of the pool such that the light fixture is contained within the pool and is proximate to a non-recessed portion of the wall, wherein the watertight connector extends into the adapter, and wherein the light fixture is connectable and disconnectable from the watertight connector while the light fixture and the watertight connector are submerged in water; one or more locking receptacles positioned in the watertight connector and one or more prongs positioned on the light fixture, wherein when the one or more prongs are inserted into the one or more locking receptacles and the light fixture is rotated then the one or more prongs are locked within the one or more locking receptacles, and water is forced out.

2. The assembly of claim 1, further comprising a hole that is formed in said wall having a diameter that is smaller than a perimeter of said light fixture, wherein the hole has a diameter that is configured to hold at least one of said adapter and said watertight connector within said wall.

3. The assembly of claim 1, wherein said light fixture comprises an indicator to determine at least one of when said light fixture is secured to said wall and when a watertight seal is achieved.

4. The assembly of claim 1, wherein said light fixture comprises a plurality of LED bulbs.

5. The assembly of claim 1, wherein said light fixture comprises a laser light source.

6. The assembly of claim 1, wherein said light fixture is a fiber optic light.

7. The assembly of claim 1, further comprising an alignment pattern that is provided on said light fixture and said watertight connector to guide connection of said light fixture to said watertight connector.

8. The assembly of claim 1, further comprising a conduit to hold said cable between said connector and said power source.

9. The assembly of claim 1, wherein insertion of said plurality of prongs forces water out of said plurality of locking receptacles.

10. The assembly of claim 1, wherein said cable provides a control signal from a controller to said light fixture.

11. A method of connecting a light fixture to a wall of a pool, the method comprising:

providing a light fixture;

providing a watertight connector comprising a first end and a second end operable to deliver power and control signals to said light fixture through said first end, wherein the watertight connector is secured to the wall of the pool and a cable by an adapter, wherein the cable provides the power from a power source and the control signal from a controller to the light fixture when the light fixture is connected to the watertight connector, wherein the adapter is positionable within the wall of the pool such that the light fixture is contained within the pool and is proximate to a non-recessed portion of the wall, wherein the watertight connector extends into the adapter;

connecting the light fixture with the watertight connector while the light fixture and the connector are submerged in water, wherein the connection of the light fixture with the watertight connector forces the water away from the cable; providing one or more locking receptacles on at least one of the light fixture and the watertight connector; and providing one or more prongs on at least the other of the light fixture and the watertight connector, wherein when the one or more prongs are inserted into the one or more locking receptacles and the light fixture is rotated then the one or more prongs are locked within the one or more locking receptacles and the water is forced away from the cable.

12. The method of claim 11, wherein the one or more locking receptacles are positioned in the watertight connector and the one or more prongs are positioned along the light fixture.

13. The method of claim 11, further comprising forming a hole in the wall of the pool, wherein the hole has a diameter that is smaller than a perimeter of said light fixture, the hole having a diameter that is configured to hold at least one of said adapter and said watertight connector within said wall.

14. The method of claim 11, wherein said light fixture comprises an indicator to determine at least one of when said light fixture is secured to said wall and when a water tight seal is achieved.

15. The method of claim 11, wherein said light fixture comprises a plurality of LED bulbs.

16. The method of claim 11, wherein said light fixture comprises a laser light source.

17. The method of claim 11, wherein said light fixture is a fiber optic light.

18. The method of claim 11, further comprising guiding the connection of the light fixture with the watertight connector by way of an alignment pattern on said light fixture and said watertight connector.

* * * * *